US007926758B2

(12) United States Patent
Chiu et al.

(10) Patent No.: US 7,926,758 B2
(45) Date of Patent: Apr. 19, 2011

(54) APPARATUS AND SYSTEM FOR ROLL-TO-ROLL PROCESSING

(75) Inventors: Wan-Wen Chiu, Cyonglin Township, Hsinchu County (TW); Chao-Kai Cheng, Hsinchu (TW); Jie-Kai Chang, Daliao Township, Kaohsiung County (TW); Cheng-Yi Wang, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 1297 days.

(21) Appl. No.: 11/461,121

(22) Filed: Jul. 31, 2006

(65) Prior Publication Data

US 2008/0029640 A1 Feb. 7, 2008

(51) Int. Cl.
*B65H 23/32* (2006.01)

(52) U.S. Cl. ..... 242/615.21; 242/566

(58) Field of Classification Search ..... 242/615, 242/615.12, 615.21, 563, 563.1, 566
See application file for complete search history.

(56) References Cited

U.S. PATENT DOCUMENTS

| | | | | |
|---|---|---|---|---|
| 3,337,107 | A * | 8/1967 | Catallo et al. | 242/615.21 |
| 3,642,227 | A * | 2/1972 | Lewis | 242/615.21 |
| 3,954,213 | A * | 5/1976 | Andersen | 242/615.21 |
| 4,528,833 | A * | 7/1985 | Inaike et al. | 72/166 |
| 4,788,846 | A * | 12/1988 | Morita et al. | 242/615.21 |
| 5,016,801 | A * | 5/1991 | Gilat et al. | 242/615.21 |
| 5,996,491 | A | 12/1999 | Kishine et al. | |
| 6,013,212 | A * | 1/2000 | Planeta et al. | 242/615.21 |
| 6,666,399 | B2 * | 12/2003 | Perdu | 242/615.21 |
| 6,672,921 | B1 | 1/2004 | Liang et al. | |
| 6,902,135 | B2 * | 6/2005 | Boucher | 242/615.21 |
| 2002/0195008 | A1 | 12/2002 | Perdu | |
| 2005/0055720 | A1 | 3/2005 | Atad et al. | |
| 2005/0197748 | A1 | 9/2005 | Holst et al. | |
| 2006/0009240 | A1 | 1/2006 | Katz | |

OTHER PUBLICATIONS

Ralf Pabst, et al. "Relay-Based Deployment Concepts for Wireless and Mobile Broadband Radio", Wireless World Research Forum, IEEE Communications Magazine, pp. 80-89 (Sep. 2004).

Jing Nie, et al., "Communication with Bandwidth, Optimization in IEEE 802.16 and IEEE 802.11 Hybrid Networks", Proceedings of ISCT 2005, pp. 26-29 (Jul. 2005).

Norbert Esseling, et al., Performance Evaluation Of A Fixed Relay Concept For Next Generation Wireless Systems, IEEE, pp. 744-751 (2004).

Office Action from corresponding Chinese Appl. No. 2007101434277, dated Jun. 5, 2009.

* cited by examiner

*Primary Examiner* — William A Rivera
(74) *Attorney, Agent, or Firm* — Alston & Bird LLP

(57) ABSTRACT

An apparatus for roll-to-roll processing includes a first roller for converting the transmission of a roll of flexible material from a first direction to a second direction substantially orthogonal to the first direction, a second roller spaced apart from the first roller and extending transversely with respect to the first roller for converting the transmission of the roll of flexible material from the second direction to a third direction substantially orthogonal to the first direction and the second direction, and a third roller spaced apart from the second roller and extending perpendicularly with respect to the first roller for converting the transmission of the roll of flexible material from the third direction to a fourth direction, wherein the roll of flexible material includes a first side and a second side, and wherein the first roller, the second roller and the third roller contact the same one of the first side and the second side of the roll of flexible material.

15 Claims, 8 Drawing Sheets

APPARATUS AND SYSTEM FOR ROLL-TO-ROLL PROCESSING

BACKGROUND OF THE INVENTION

The present invention relates generally to roll-to-roll manufacturing, and more particularly, to an apparatus and system for roll-to-roll processing.

Roll-to-roll processing, reel-to-reel processing or web-handling processing, which was widely used in textile and paper printing industries in the past, has become popular today in manufacturing flexible substrates. A roll-to-roll processing system relates to one using rollers for controlling transmission direction, tension and speed of a roll of, for example, flexible material in a continuous manufacturing process. Such a continuous manufacturing process has the advantages of manpower saving, manufacturing cost reduction and compatibility of manufacturing systems with materials of different dimensions. A flexible substrate provides a base for a flexible circuit board or a flexible flat panel display. As compared to their rigid counterparts, flexible circuit boards and flexible flat panel displays are generally thinner and more light-weight, and allow three-dimensional assembly with other circuit boards or devices. However, the flexible circuit boards and flat panel displays cost more than their rigid counterparts. To lower the cost, an interest in the roll-to-roll processings for flexible substrates is rapidly increasing.

Conventional processes for roll-to-roll manufacturing are often designed in a double-side contact manner, where both sides of a roll of flexible material will contact rollers during processing. Processes based on double-side contact may facilitate tension control and offset control so as to ensure manufacturing quality. Such processes may incur contamination to a working surface of the roll of flexible material. One solution to overcome the contamination issue is to clamp the edges of the roll of flexible material. However, the clamping method may incur other issues such as transmission instability and the difficulty in precision control. Another solution is to rearrange the processing stations required for a double-side process in a closed-loop to emulate a single-side process, where only one side of a roll of flexible substrate is allowed to contact rollers. However, such a method may incur other issues such as inconsistence in the processing stations. It is thus desirable to have a roll-to-roll process that is designed in a single-side contact manner, uses economy of scale for mass production, and maintains consistence in various processing stations.

BRIEF SUMMARY OF THE INVENTION

The present invention is directed to an apparatus and system for roll-to-roll processing that obviate one or more problems resulting from the limitations and disadvantages of the prior art.

In accordance with an embodiment of the present invention, there is provided an apparatus for roll-to-roll processing that comprises a first roller configured to convert the transmission of a roll of flexible material from a first direction to a second direction, the first direction and the second direction forming a first angle with respect to one another, a second roller spaced apart from the first roller and extending transversely with respect to the first roller, the second roller being configured to convert the transmission of the roll of flexible material from the second direction to a third direction, the second direction and the third direction forming a second angle with respect to one another, and a third roller spaced apart from the second roller and extending transversely with respect to the second roller, the third roller being configured to convert the transmission of the roll of flexible material from the third direction to a fourth direction, the third direction and the fourth direction forming a third angle with respect to one another, wherein the roll of flexible material includes a first side and a second side, and wherein the first roller, the second roller and the third roller contact the same one of the first side and the second side of the roll of flexible material during the transmission of the roll of flexible material.

Also in accordance with the present invention, there is provided an apparatus for roll-to-roll processing that comprises a first roller configured to convert the transmission of a roll of flexible material from a first direction to a second direction, a second roller spaced apart from the first roller and extending transversely with respect to the first roller, the second roller being configured to convert the transmission of the roll of flexible material from the second direction to a third direction, a third roller spaced apart from the second roller and extending transversely with respect to the first roller, the third roller being configured to convert the transmission of the roll of flexible material from the third direction to a fourth direction, a fourth roller spaced apart from the third roller and extending in parallel with the third roller, the fourth roller being configured to convert the transmission of the roll of flexible material from the fourth direction to a fifth direction, a fifth roller spaced apart from the fourth roller and extending transversely with respect to the first roller, the fifth roller being configured to convert the transmission of the roll of flexible material from the fifth direction to a sixth direction, and a sixth roller spaced apart from the fifth roller and extending in parallel with the first roller, the sixth roller being configured to convert the transmission of the roll of flexible material from the sixth direction to a direction in parallel with the first direction, wherein the roll of flexible material includes a first side and a second side, and wherein the first to sixth rollers contact the same one of the first side and the second side of the roll of flexible material during the transmission of the roll of flexible material.

Further in accordance with the present invention, there is provided an apparatus for roll-to-roll processing that comprises a first roller configured to convert the transmission of a roll of flexible material in a transmission course from a first direction to a second direction, a second roller disposed immediately after the first roller in the course of transmission and configured to convert the transmission of the roll of flexible material from the second direction to a third direction, the direction in which the second roller extends and the third direction form a first angle with respect to one another, and a third roller disposed immediately after the second roller in the course of transmission and configured to convert the transmission of the roll of flexible material from the third direction to a fourth direction, the direction the fourth roller extends and the third direction form a second angle with respect to one another, the first angle and the second angle being complementary to one another, wherein the roll of flexible material includes a first side and a second side, and wherein the first roller, the second roller and the third roller contact the same one of the first side and the second side of the roll of flexible material during the transmission of the roll of flexible material.

Still in accordance with the present invention, there is provided a system for roll-to-roll processing that comprises a plurality of stations configured to process a roll of flexible material, at least one of the plurality of stations including a container, a first roller configured to convert the transmission of the roll of flexible material from a first direction to a second direction, the first direction and the second direction forming a first angle with respect to one another, a second roller held in the container and extending transversely with respect to the first roller, the second roller being configured to convert the transmission of the roll of flexible material from the second direction to a third direction, the second direction and the third direction forming a second angle with respect to one another, and a third roller held in the container and configured to convert the transmission of the roll of flexible material from the third direction to a fourth direction, the third direction and the fourth direction forming a third angle with respect to one another, wherein the roll of flexible material includes a first side and a second side, and wherein the first roller, the second roller and the third roller contact the same one of the first side and the second side of the roll of flexible material during the transmission of the roll of flexible material.

Yet still in accordance with the present invention, there is provided a system for roll-to-roll processing that comprises a plurality of stations configured to process a roll of flexible material, at least one of the plurality of stations including a container, a first roller configured to convert the transmission of the roll of flexible material from a first direction to a second direction, a second roller held in the container and extending transversely with respect to the first roller, the second roller being configured to convert the transmission of the roll of flexible material from the second direction to a third direction, a third roller held in the container and extending transversely with respect to the first roller, the third roller being configured to convert the transmission of the roll of flexible material from the third direction to a fourth direction, a fourth roller held in the container and extending in parallel with the third roller, the fourth being configured to convert the transmission of the roll of flexible material from the fourth direction to a fifth direction, a fifth roller held in the container and extending transversely with respect to the first roller, the fifth roller being configured to convert the transmission of the roll of flexible material from the fifth direction to a sixth direction, and a sixth roller extending in parallel with the first roller, the sixth roller being configured to convert the transmission of the roll of flexible material from the sixth direction to the first direction, wherein the roll of flexible material includes a first side and a second side, and wherein the first to sixth rollers contact the same one of the first side and the second side of the roll of flexible material during the transmission of the roll of flexible material.

Also in accordance with the present invention, there is provided an apparatus for roll-to-roll processing that comprises a number of rollers configured to transmit a roll of flexible material in different directions at different levels, the roll of flexible material including a first side and a second side, wherein the number of rollers contact the same one of the first side and the second side of the roll of flexible material during the transmission of the roll of flexible material.

Additional features and advantages of the present invention will be set forth in portion in the description which follows, and in portion will be obvious from the description, or may be learned by practice of the invention. The features and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Reference will now be made in detail to the present embodiments of the invention, examples of which are illustrated in the accompanying drawings. Wherever possible, the same reference numbers will be used throughout the drawings to refer to the same or like portions.

Figure 1A:
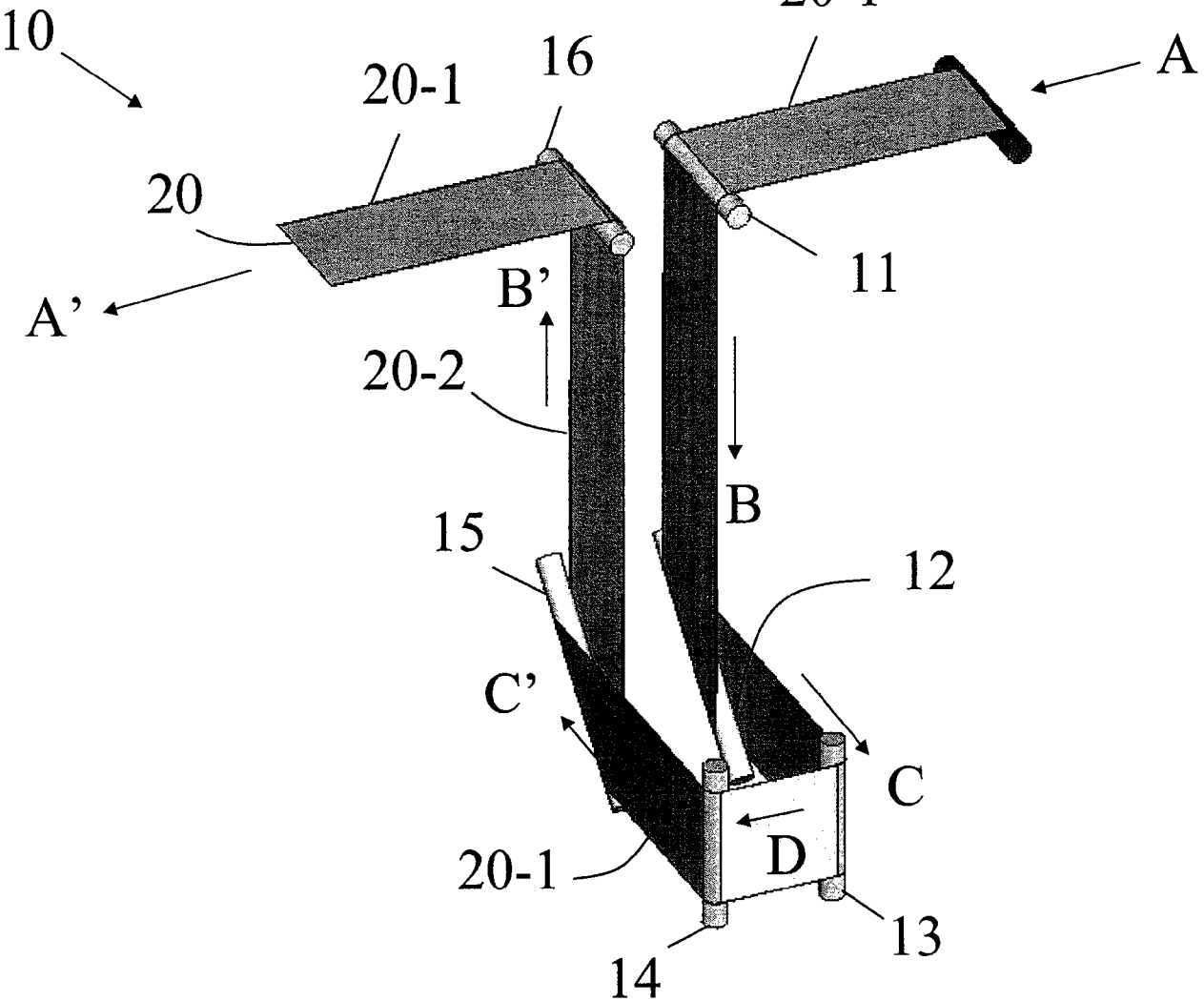
FIG. 1A is a schematic diagram of an apparatus for roll-to-roll processing in accordance with one embodiment of the present invention.

FIG. 1A is a diagram of an apparatus 10 for roll-to-roll processing in accordance with one embodiment of the present invention. Referring to FIG. 1A, the apparatus 10 includes a plurality of rollers 11 to 16 for transmitting a roll of flexible material 20. The flexible material 20 includes but is not limited to polyimide or flexible fiberglass-weave epoxy (FR4), and has a first side 20-1 for process contact and a second side 20-2 for roller contact. The rollers 11 to 16 are elongated cylindrical devices made of, for example, metal or plastic. Each of the plurality of rollers 11 to 16 rotates about an axis and is connected to a supporting surface (not shown).

In operation, the first roller 11 converts the transmission of the roll of flexible material 20 from a first direction A to a second direction B. The directions A and B may form a first angle with respect to one another. The second roller 12, spaced apart from the first roller 11 and extending transversely with respect to the first roller 11, converts the transmission of the roll of flexible material 20 from the second direction B to a third direction C. The directions B and C may form a second angle with respect to one another. The third roller 13, spaced apart from the first roller 11 and second roller 12 and extending transversely with respect to the first roller 11, converts the transmission of the roll of flexible material 20 from the third direction C to a fourth direction D. The directions C and D may form a third angle with respect to one another. The fourth roller 14, extending substantially in parallel with the third roller 13, converts the transmission of the roll of flexible material 20 from the fourth direction D to a fifth direction C'. The fifth roller 15, extending transversely with respect to the fourth roller 14, converts the transmission of the roll of flexible material 20 from the fifth direction C' to a sixth direction B'. The sixth roller 16, extending substantially in parallel with the first roller 11, converts the transmission of the roll of flexible material 20 from the sixth direction B' back to a seventh direction A'. In one embodiment according to the present invention, the first direction A is in parallel with the seventh direction A'. In another embodiment, the first direction A is in parallel with the fourth direction D. In still another embodiment, the first, second and third angles may be orthogonal to each other so that the directions A, B and C are orthogonal to each other. Furthermore, the directions B' and C' are reverse to the directions B and C, respectively.

During the transmission, the rollers 11 to 16 contact the second side 20-2 of the roll of flexible material 20 and do not contact the first side 20-1 thereof, resulting in a single-side contact operation. In one embodiment according to the present invention, the roll of flexible material 20 has a width of approximately 25 centimeters or 50 centimeters, a length of approximately 100 to 300 meters, and a thickness of approximately 0.1 millimeters (mm) to several millimeters. The transmission speed is approximately 1 m/sec (meter per second) and may be subject to change in different applications.

Figure 1B:
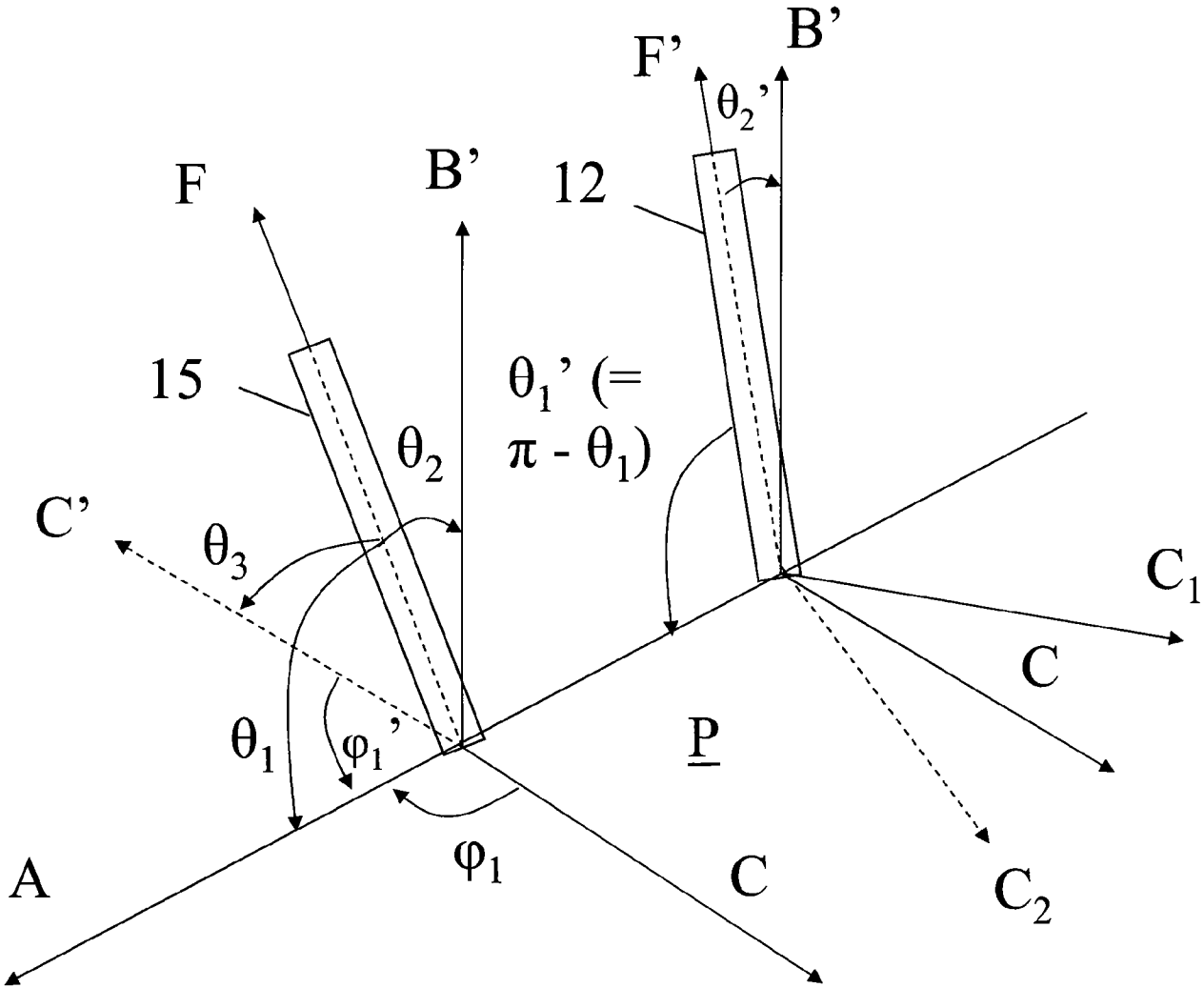
FIG. 1B is a schematic diagram of a pair of rollers of the apparatus illustrated in FIG. 1A.

FIG. 1B is a schematic diagram of a pair of rollers 12 and 15 of the apparatus 10 illustrated in FIG. 1A. Referring to FIG. 1B, the second roller 12 and the fifth roller 15 extend substantially in a complementary relationship with respect to one another. The fifth roller 15 disposed on a plane P extends in a direction F, which forms a first angle $\theta_1$ with the first direction A, a second angle $\theta_2$ with the sixth direction B', and a third angle $\theta_3$ with the fifth direction C'. The second roller 12 disposed on the plane P extends in a direction F', which forms a first angle $\theta_1'$ with the first direction A and a second angle $\theta_2'$ with the sixth direction B'. In one embodiment according to the present invention, the first angle $\theta_1$ is approximately 90° (degrees), the second angle $\theta_2$ is approximately 45°, and the third angle $\theta_3$ is approximately 45°. As a result, the first direction A is orthogonal to the third direction C (i.e., $\phi_1$=90°) and the fifth direction C' (i.e., $\phi_1'$=90°).

In other embodiments, the second roller 12 need not be oriented at an angle of 45° (i.e., $\theta_2'\neq 45°$) with respect to the sixth direction B'. Rather, the second roller 12 may be oriented such that the roll of flexible material 20 runs in a direction $C_1$ away from the plane P (e.g., when the second angle $\theta_2'$ is greater than 45°) or runs in a direction $C_2$ into the plane P (e.g., when the second angle $\theta_2'$ is smaller than 45°). Preferably, the second angle $\theta_2$ of the fifth roller 15 is substantially equal to the second angle $\theta_2'$ of the second roller 12.

In another embodiment, the fifth roller 15 need not be oriented at an angle of 90° (i.e., $\theta_1\neq 90°$) with respect to the first direction A and the first angle $\theta_1'$ preferably is substantially complementary to the first angle $\theta_1$, i.e., $\theta_1'=\pi-\theta_1$. Furthermore, the angle $\phi_1$ is substantially complementary to the angle $\phi_1'$, i.e., $\phi_1'=\pi-\phi_1$.

Figure 1C:
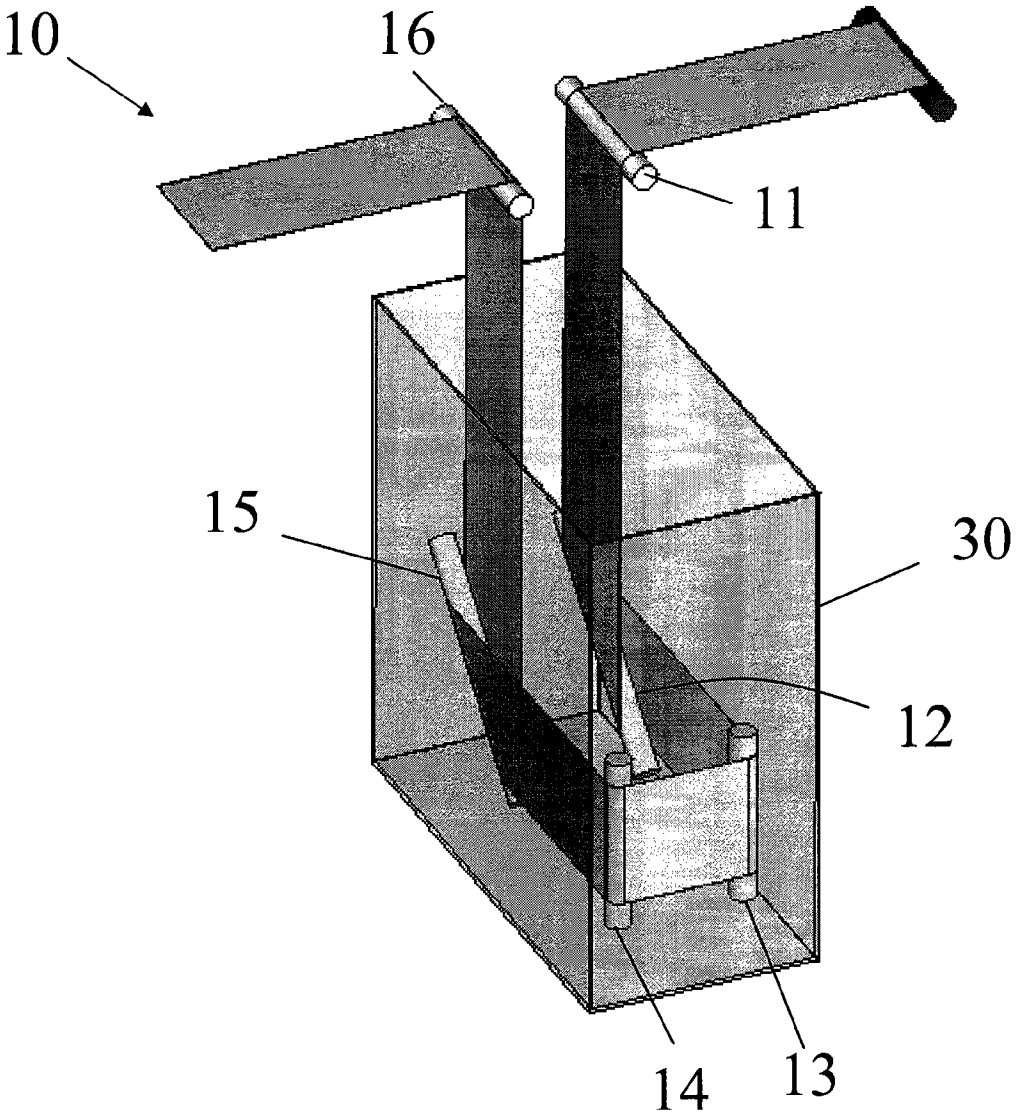
FIG. 1C is a schematic diagram of an application of the apparatus for roll-to-roll processing illustrated in FIG. 1A.

FIG. 1C is a schematic diagram of an application of the apparatus 10 for roll-to-roll processing illustrated in FIG. 1A. Referring to FIG. 1C, the second roller 12, third roller 13, fourth roller 14 and fifth roller 15 are held in a container 30 for a wet treatment of the roll of flexible material 20 in the roll-to-roll processing. The container 30 may include different solutions or chemicals for a wet treatment such as dipping, cleansing or plating, depending on the properties required on the roll of flexible material 20. The distance between the rollers 11 to 16 is subject to change for different treatments. For example, if a treatment requires a longer time of processing, the distance between the second roller 12 and the third roller 13 is lengthened. Furthermore, additional rollers (not shown) may be added in the course of transmission from the first roller 11 to the sixth roller 16 if tension control for such a lengthened course is required.

Figure 2:
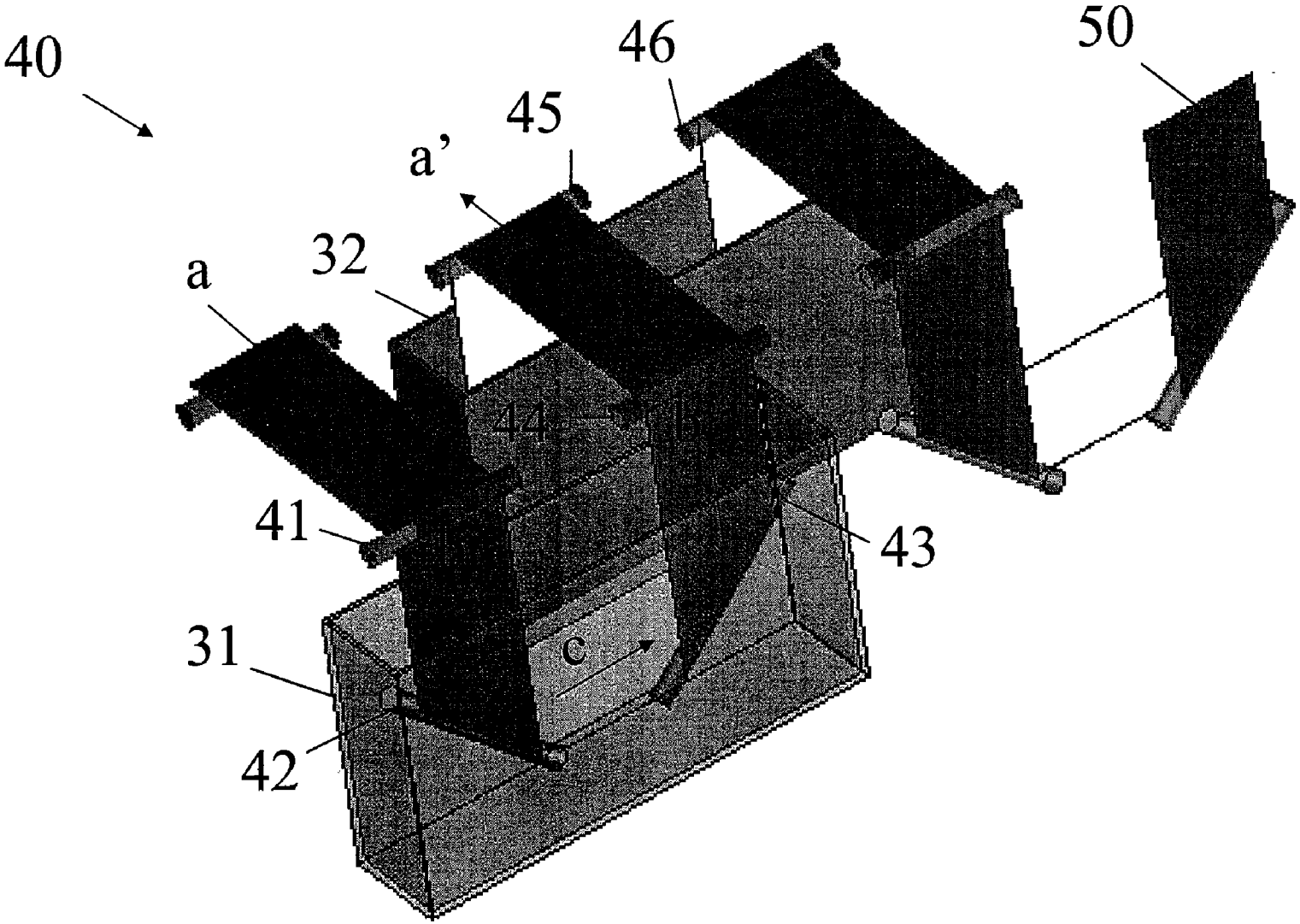
FIG. 2 is a schematic diagram of an apparatus for roll-to-roll processing in accordance with another embodiment of the present invention.

FIG. 2 is a schematic diagram of an apparatus 40 for roll-to-roll processing in accordance with another embodiment of the present invention. Referring to FIG. 2, the apparatus 40 includes a first set of rollers 41 to 44 for transmitting a roll of flexible material 50. In operation, a first roller 41 converts the transmission from a first direction "a" to a second direction "b". The directions "a" and "b" may form a first angle with respect to one another. A second roller 42, spaced apart from the first roller 41 and extending transversely with respect to the first roller 41, converts the transmission from the second direction "b" to a third direction "c". The directions "b" and "c" may form a second angle with respect to one another. A third roller 43, spaced apart from the second roller 42 and extending in a complementary relationship with the second roller 42, converts the transmission from the third direction "c" to a fourth direction "b". The directions "c" and "b" may form a third angle with respect to one another. A fourth roller 44, spaced apart from the first roller 41, converts the transmission from the fourth direction "b" to a fifth direction "a". In one embodiment according to the present invention, the first roller 41 extends substantially in parallel with the fourth roller 44 so that the fifth direction "a" is substantially reverse to the first direction "a". In another embodiment, the first roller 41 extends in a complementary relationship with the fourth roller 44, and the second roller 42 extends in parallel with the third roller 43 so that the fifth direction "a" extends in a complementary relationship with the first direction "a". In still another example, the first, second and third angles may be orthogonal to each other.

The apparatus 40 includes a second set of rollers (only rollers 45 and 46 are shown) for transmitting the roll of flexible material 50 from the fifth direction "a'" to the first direction "a". In one embodiment, a first container 31 associated with the first set of rollers 41 to 44 is provided for a first treatment, and a second container 32 associated with the second set of rollers 45 and 46 is provided for a second treatment. In one aspect, the second treatment is different from the first treatment. In another aspect, the second treatment is similar to the first treatment for an extended processing of the first treatment.

Figure 3:
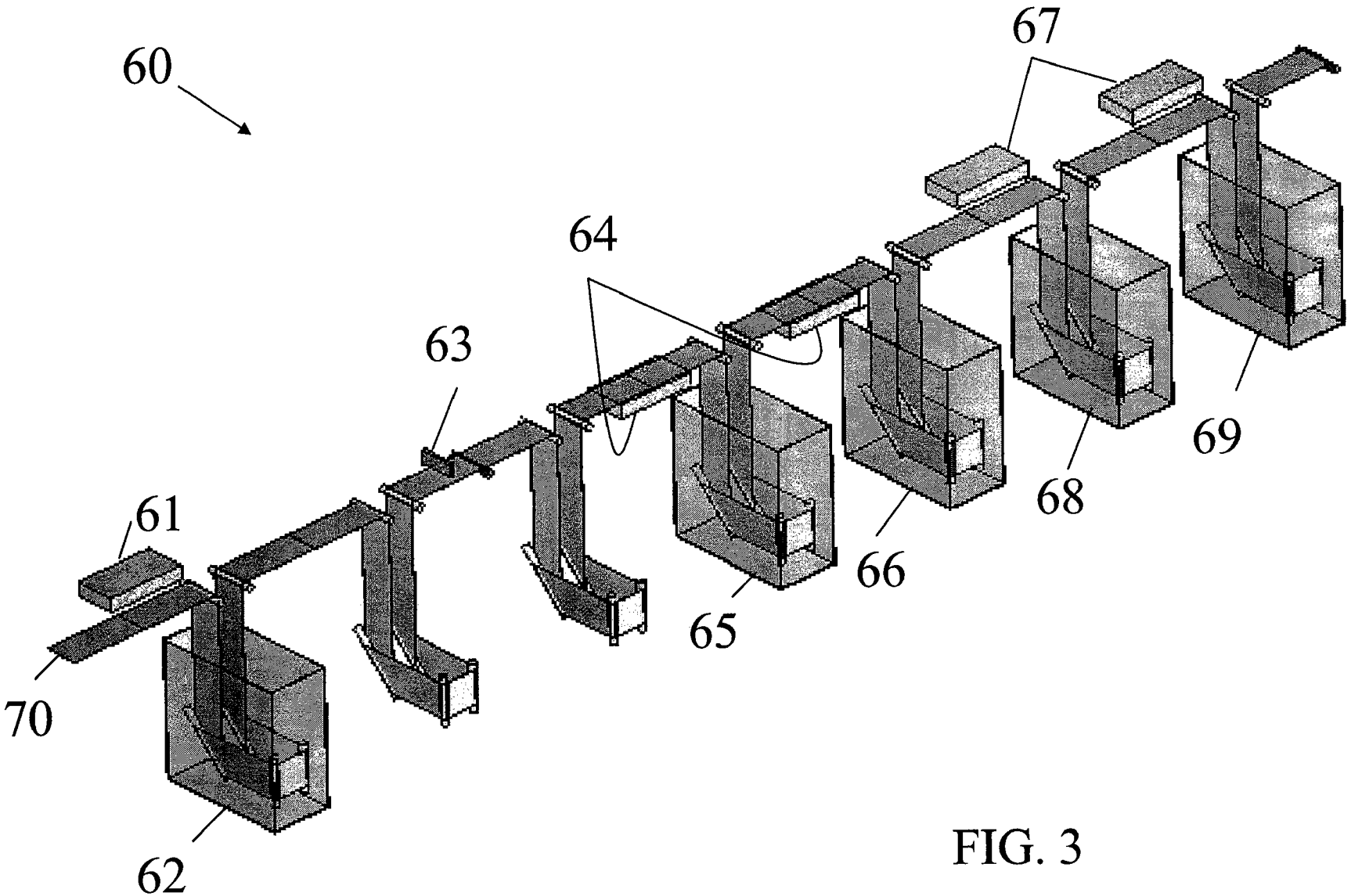
FIG. 3 is a schematic diagram of a system for a continuous processing of a roll of flexible material in accordance with one embodiment of the present invention.

FIG. 3 is a schematic diagram of a system 60 for a continuous processing of a roll of flexible material 70 in accordance with one embodiment of the present invention. Referring to FIG. 3, the system 60 includes a plurality of processing stations 61 to 69 for processing the roll of flexible material 70. In one embodiment, the system 60 includes a printing station 63, dry treatment stations 61, 64, 67 and wet treatment stations 62, 65, 66, 68, 69 for manufacturing a roll of flexible substrate out of the flexible material 70. The dry treatment stations include at least one of a drying unit, a plasma unit, an ultraviolet (UV) light unit, a baking or heating unit and a cutting unit. For example, the stations 64 and 67 may serve as a baking unit and a UV light unit, respectively. The wet treatment stations include at least one of a dipping unit, a cleaning unit, an etching unit, a plating unit and a self-assembly unit. Each of the wet treatment stations may include at least one container and at least one apparatus such as the apparatus 10 illustrated in FIG. 1A and FIG. 1C and the apparatus 40 illustrated in FIG. 2. The printing station 63 includes a printing head for printing nano-particles, organic materials, solvent-base ink, wax-type ink, UV-curable ink or catalyst on the roll of flexible material 70.

In another embodiment, the system 60 includes a printing station 63 and dry treatment stations such as curing and heating stations for manufacturing a roll of flexible circuit board out of the flexible material 70. The printing station 63 directly prints metal-containing ink on the roll of flexible material 70.

Since no wet treatment is required, the wet treatment stations are eliminated. The system 60 may also be applicable to the printing process of flexible flat panel displays by appropriate arrangement of the stations 61 to 69.

Figure 4:
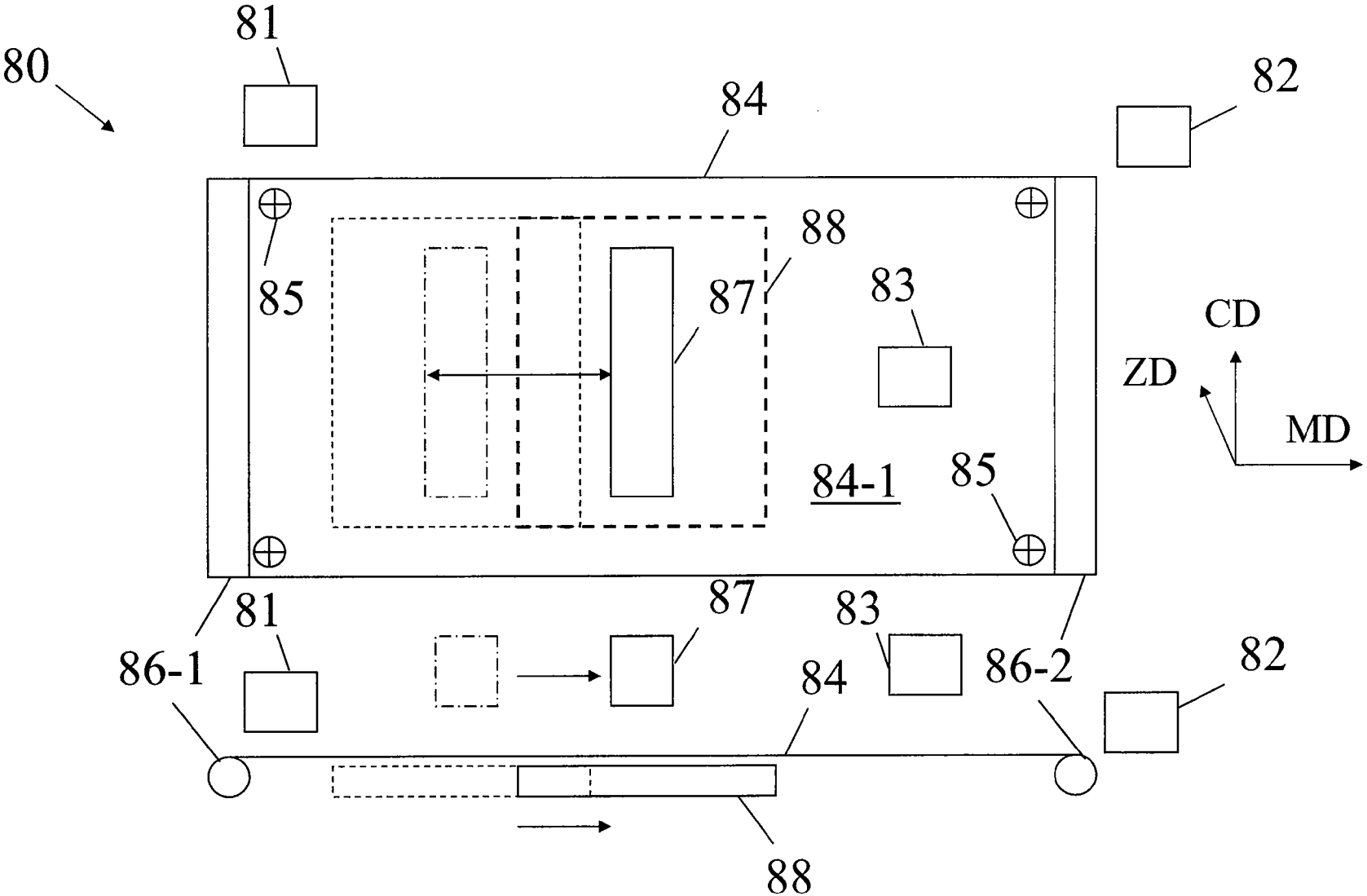
FIG. 4 is a schematic top plan view and side elevational view of a detecting system in accordance with one embodiment of the present invention.

FIG. 4 is a schematic top plan view and a side elevational view of a detecting system 80 in accordance with one embodiment of the present invention. Referring to FIG. 4, the detecting system 80 includes a first sensor 81, a second sensor 82 and a third sensor 83 for detecting the transmission of a roll of flexible material 84. The roll of flexible material 84 transmits in a first direction MD, which is orthogonal to a second direction CD and a third direction ZD. Specifically, the second direction CD extends across the first direction MD, and the third direction ZD extends perpendicularly with respect to the first direction MD. The first sensor 81 is disposed in the third direction ZD above a first side 84-1 of the roll of flexible material 84 and detects alignment marks 85 formed on the first side 84-1, thereby collecting information regarding the tension or speed of the roll of flexible material 84. The second sensor 82 is disposed near one end of one of rollers 86-1 and 86-2 and detects the amount of slide of the roll of flexible material 84 in the second direction CD. The third sensor 83 is disposed in the third direction ZD above the first side 84-1 and detects the distance between a printing head 87 and the first side 84-1. A printing head 87 is disposed in the third direction ZD above the first side 84-1 for printing ink on the first side 84-1. An actuator 88, which is disposed under a second side (not numbered) of the roll of flexible material 84 between the rollers 86-1 and 86-2, is movable back and forth along the first direction MD. Since the printing head 87 is driven by the actuator 88, the printing head 87 is also mobile between the rollers 86-1 and 86-2 along the first direction MD. In one embodiment according to the present invention, the actuator 88 is vacuum attached to the second side and is able to move along without causing vibration to the flexible material 84.

Figure 5:
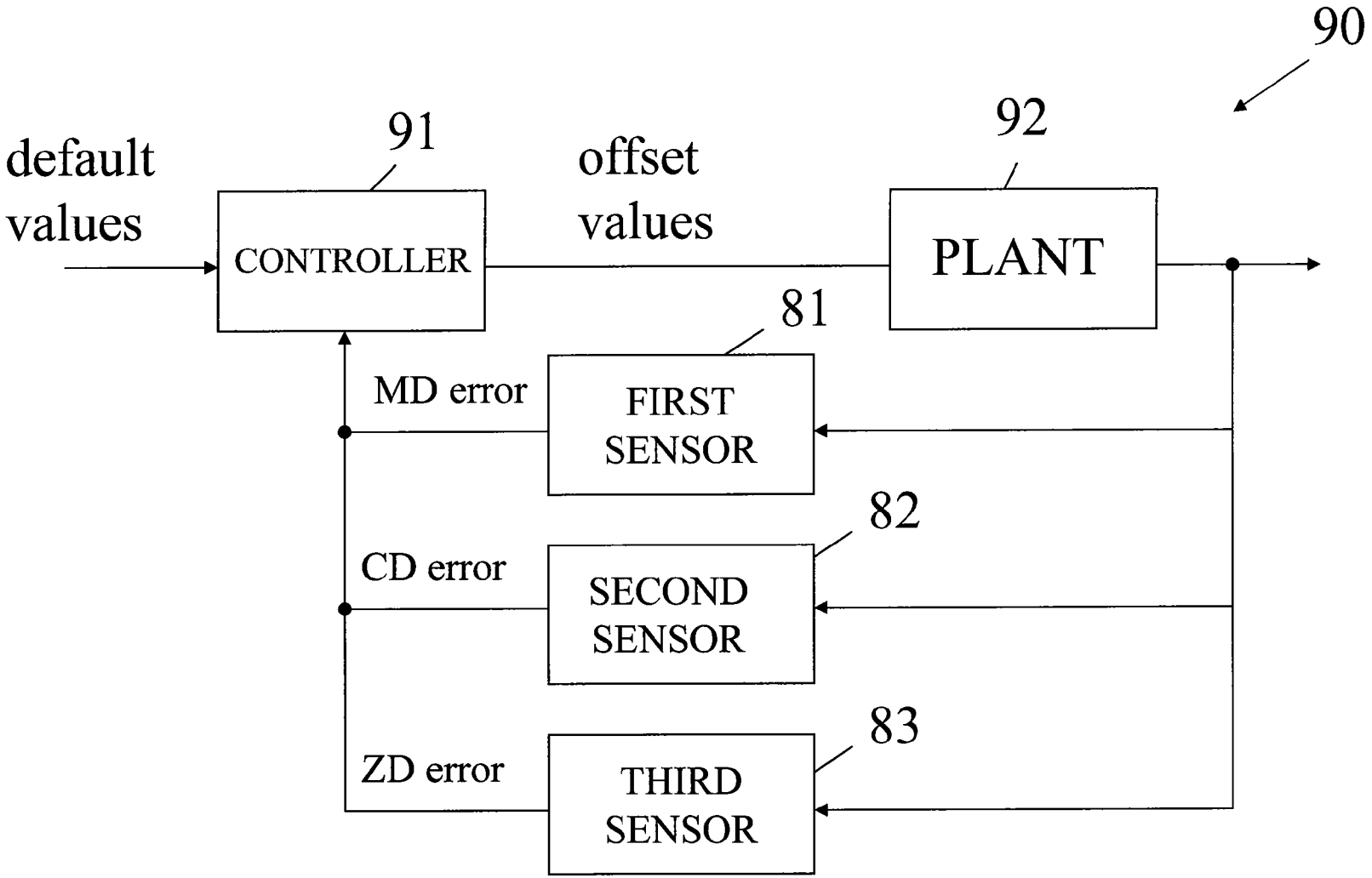
FIG. 5 is a diagram of a control system 90 in accordance with one embodiment of the present invention.

FIG. 5 is a diagram of a control system 90 in accordance with one embodiment of the present invention. Referring to FIG. 5, the control system 90 includes a controller 91 and a plant 92. The plant 92 refers to a device or system under the control of the controller 91, and may include a section of a roll of flexible material to be controlled. Also referring to FIG. 4, the controller 91 receives signals including displacement errors in the directions MD, CD and ZD from the sensors 81, 82 and 83, respectively. The controller 91 then compares the signals with default values, and provides offset signals to adjust the plant 92. In response to an offset signal regarding a compensation in the first direction MD, the actuator 88 is controlled to adjust the tension of the roll of flexible material 84. In response to an offset signal regarding a compensation in the second direction CD, at least one of the rollers 86-1 and 86-2 is controlled to adjust the slide of the roll of flexible material 84. The rollers 86-1 and 86-2 may include a surface having a greater friction coefficient value than rollers for transmission only. In response to an offset signal regarding a compensation in the third direction ZD, the printing head 87 is controlled to adjust the distance from the first side 84-1. In one embodiment, the controller 91 includes one of a fuzzy controller, a proportional-integral-differential ("PID") controller and a fuzzy PID controller.

Figure 6:
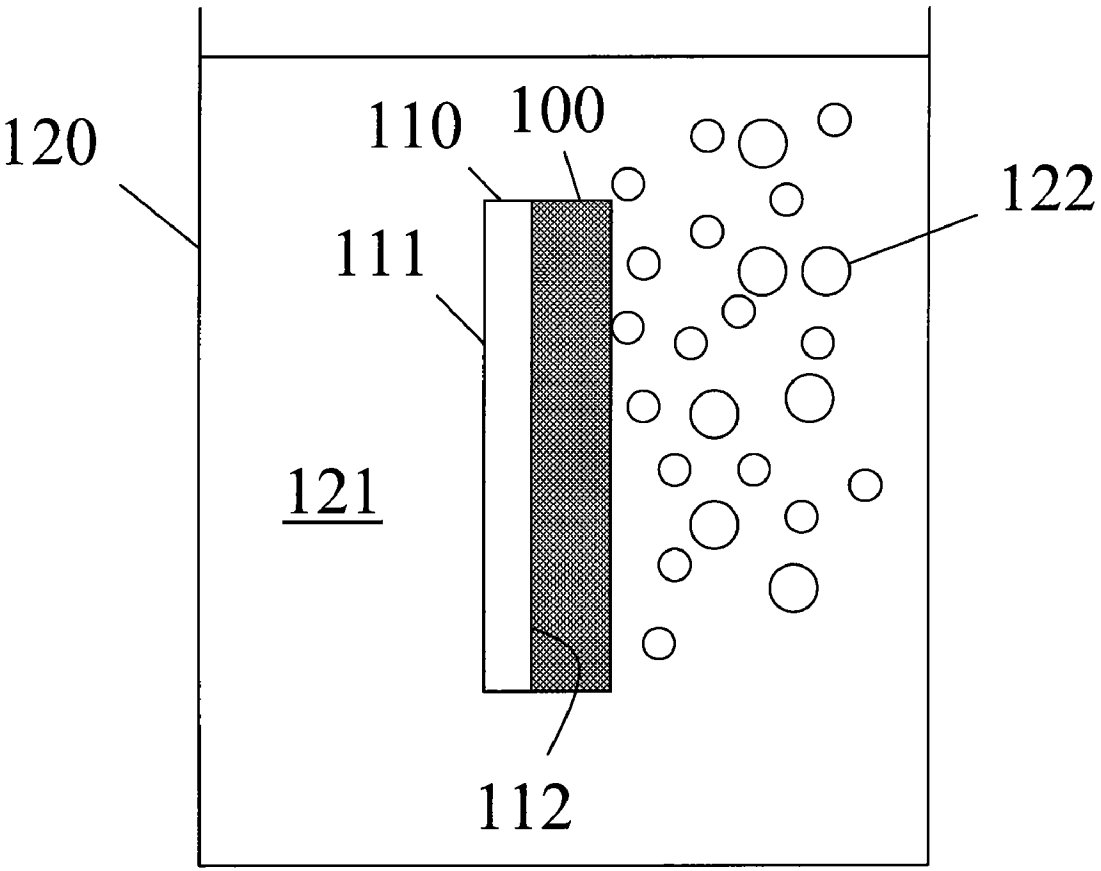
FIG. 6 is a schematic diagram of a roller in accordance with one embodiment of the present invention.

FIG. 6 is a schematic diagram of a roller 100 in accordance with one embodiment of the present invention. Referring to FIG. 6, a roll of flexible material 110 including a first side 111 and a second side 112 is immersed in a solution 121 held in a container 120 for a wet treatment, for example, chemical plating. One of the purposes of chemical plating is to form conductive lines on the first side 111. The roller 100 includes a plurality of holes having dimensions in the micro order formed on a surface of the roller 100. When air flows into the roller 110, bubbles 122 escape from the holes of the roller 110. The bubbles 122 help reduce the friction between the roller 100 and the second side 112, and help activate the solution. Since the bubbles 122 generally do not contact the first side 111, the first side 111 is free from bubble attack during the wet treatment. In a conventional technique, however, bubbles are generated by a bubble generator disposed on a bottom surface of a container and will evenly contact both sides of a roll of material, adversely resulting in cavitation on the process side. The cavitation may cause disconnection in conductive lines. The roller 100 according to the present invention has overcome the cavitation issue in the conventional technique.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

We claim:

1. An apparatus for roll-to-roll processing comprising:

a first roller configured to convert the transmission of a roll of flexible material from a first direction to a second direction, the first direction and the second direction forming a first angle with respect to one another;

a second roller spaced apart from the first roller and extending transversely with respect to the first roller, the second roller being configured to convert the transmission of the roll of flexible material from the second direction to a third direction, the second direction and the third direction forming a second angle with respect to one another;

a third roller spaced apart from the second roller and extending transversely with respect to the second roller, the third roller being configured to convert the transmission of the roll of flexible material from the third direction to a fourth direction, the third direction and the fourth direction forming a third angle with respect to one another; and a fourth roller spaced apart from the third roller and extending transversely with respect to the third roller, the fourth roller being configured to convert the transmission of the roll of flexible material from the fourth direction to a fifth direction that is substantially parallel to the first direction, wherein the roll of flexible material includes a first side and a second side, and wherein the first roller, the second roller, the third roller and the fourth roller each contact the same one of the first side and the second side of the roll of flexible material during the transmission of the roll of flexible material.

2. The apparatus of claim 1 further comprising a fifth roller positioned to receive the roll of flexible material after the second roller and to transmit the roll of flexible material in a direction substantially parallel to the first direction such that the roll of flexible material lies in a plane, after contact with the fifth roller, that is substantially perpendicular to a plane in which the roll of flexible material lies while being transmitted in the first direction.

3. The apparatus of claim 1, wherein the second angle and the third angle are complementary.

4. The apparatus of claim 1, wherein at least one of the first to fourth rollers is held in a container.

5. The apparatus of claim 1, wherein at least one of the first to fourth rollers includes a surface having a greater friction coefficient value than another one of the first to fourth rollers.

6. The apparatus of claim 1, wherein at least one of the first to fourth rollers includes a surface into which a plurality of holes are formed.

7. A system for roll-to-roll processing comprising a plurality of stations configured to process a roll of flexible material, at least one of the plurality of stations including:

a first roller configured to convert the transmission of a roll of flexible material from a first direction to a second direction, the first direction and the second direction forming a first angle with respect to one another;

a second roller spaced apart from the first roller and extending transversely with respect to the first roller, the second roller being configured to convert the transmission of the roll of flexible material from the second direction to a third direction, the second direction and the third direction forming a second angle with respect to one another;

a third roller spaced apart from the second roller and extending transversely with respect to the second roller, the third roller being configured to convert the transmission of the roll of flexible material from the third direction to a fourth direction, the third direction and the fourth direction forming a third angle with respect to one another; and a fourth roller spaced apart from the third roller and extending transversely with respect to the third roller, the fourth roller being configured to convert the transmission of the roll of flexible material from the fourth direction to a fifth direction that is substantially parallel to the first direction, wherein the roll of flexible material includes a first side and a second side, and wherein the first roller, the second roller, the third roller and the fourth roller each contact the same one of the first side and the second side of the roll of flexible material during the transmission of the roll of flexible material.

8. The system of claim 7, wherein at least one of the first to fourth rollers includes a surface having a greater friction coefficient value than another one of the first to fourth rollers.

9. The system of claim 7, wherein at least one of the first to fourth rollers includes a surface into which a plurality of holes are formed.

10. The system of claim 7, wherein one of the plurality of stations includes a sensor for detecting alignment marks formed on the first side of the roll of flexible material.

11. The system of claim 10 further comprising a controller for receiving a signal from the sensor.

12. The system of claim 7, wherein one of the plurality of stations includes a sensor for detecting a slide of the roll of flexible material in a direction across the direction in which the roll of flexible material transmits.

13. The system of claim 12 further comprising a controller for receiving a signal from the sensor.

14. The system of claim 7, wherein one of the plurality of stations includes a sensor for detecting a distance between the first side and a printing head disposed above the first side.

15. The system of claim 14 further comprising a controller for receiving a signal from the sensor.

* * * * *